US005558611A

United States Patent [19]

Focke

[11] Patent Number: 5,558,611

[45] Date of Patent: Sep. 24, 1996

[54] APPARATUS FOR SHAPING BLANKS FOR HINGE-LID PACKS WITH ESPECIALLY ROUNDED LONGITUDINAL EDGES

[75] Inventor: Heinz Focke, Verden, Germany

[73] Assignee: Focke & Co. (GmbH & Co.), Verden, Germany

[21] Appl. No.: 386,103

[22] Filed: Feb. 9, 1995

[30] Foreign Application Priority Data

Feb. 10, 1994 [DE] Germany ..... 44 04 278.7

[51] Int. Cl.[6] ..... B31B 1/52

[52] U.S. Cl. ..... 493/162; 493/180; 493/451; 493/465

[58] Field of Search ..... 493/416, 442, 493/450, 451, 459, 465, 911, 910, 968, 405, 180, 182, 162, 295, 163, 175, 176

[56] References Cited

U.S. PATENT DOCUMENTS

| | | | |
|---|---|---|---|
| 1,871,900 | 8/1932 | Mentges | 493/444 |
| 3,068,760 | 12/1962 | Gross | 493/175 |
| 3,387,841 | 6/1968 | Menell | 493/442 |
| 4,563,169 | 1/1986 | Virta et al. | 493/295 |
| 4,708,704 | 11/1987 | Focke et al. . | |
| 5,273,515 | 12/1993 | Fenske | 493/416 |

FOREIGN PATENT DOCUMENTS

| | | | |
|---|---|---|---|
| 31622 | 10/1961 | Finland | 493/451 |
| 2400680 | 8/1974 | Germany . | |
| 3001106 | 7/1981 | Germany . | |
| 3531728 | 3/1986 | Germany . | |
| 3800664 | 7/1989 | Germany . | |
| 4209141 | 9/1993 | Germany . | |

*Primary Examiner*—Jack W. Lavinder
*Attorney, Agent, or Firm*—Sughrue, Mion, Zinn, Macpeak & Seas

[57] ABSTRACT

Blanks (13) for the production of hinge-lid packs (10) with rounded longitudinal edges (11, 12) are pre-shaped in the region of the longitudinal edges (11, 12). For this purpose, a shaping station (17) is provided, which has two shaping devices (28, 29) which each have shaping tools for pre-shaping the longitudinal edges (11, 12). The centrally supplied blanks (13) are alternately fed to the one and the other shaping device (28, 29), and discharged after shaping.

19 Claims, 3 Drawing Sheets

APPARATUS FOR SHAPING BLANKS FOR HINGE-LID PACKS WITH ESPECIALLY ROUNDED LONGITUDINAL EDGES

BACKGROUND OF THE INVENTION

The invention relates to an apparatus for shaping or pre-shaping blanks for packs, especially blanks for hinge-lid packs with rounded or polygonal longitudinal edges, having a shaping station, in which the blanks are shaped by stationary, movable shaping tools, especially shaping rollers, in conjunction with counter tools, especially shaping plates, and then transported further.

Hinge-lid packs are a widespread pack type for cigarettes. Recently, such hinge-lid packs have also been designed with rounded upright longitudinal edges, or also with beveled, polygonal longitudinal edges.

The production of hinge-lid packs with rounded or similarly designed longitudinal edges requires special measures in the region of the packaging machine. An apparatus is known, in which the flat, unfolded blanks are pre-shaped in the region of the longitudinal edges. For this purpose, interacting shaping tools are provided, specifically a fixedly arranged shaping plate with round lateral margins, on the one hand, and movable shaping rollers, on the other. The latter shape the blank by corresponding relative movements around the round lateral margins of the shaping plate (U.S. Pat. No. 4,708,704).

SUMMARY OF THE INVENTION

The invention is based on the object to further develop a shaping device of this type or of a different type such that a higher performance is attained when shaping or pre-shaping the blanks for the packs.

To attain this object, the apparatus according to the invention is characterized in that the shaping station is provided with at least two shaping devices with shaping tools, wherein blanks which are successively conveyed into the shaping station can be alternately fed to the one and to the other shaping device.

According to the invention, the performance of the apparatus or of the entire packaging machine can be increased by simultaneously, or with a chronological overlap, applying the shaping treatment to a plurality of blanks in the shaping station.

In a preferred embodiment of the invention, two complete shaping devices, to which blanks are alternately fed by a transverse movement, are arranged laterally adjacent to a conveying track for the blanks and approx. in the same plane thereof. While one blank is being shaped by one shaping device, a successive blank is fed to the other shaping device.

According to the invention, shaping tools of the one and of the other shaping device, especially a shaping plate, are transversely moved for receiving a blank. In a central position, a shaped blank is first delivered, namely transported further, and then a new blank is received. Expediently, the shaping tools can be comprised of a shaping plate with shaping longitudinal margins and movable shaping rollers.

Further details of the invention relate to the design and arrangement of the shaping tools, and to members for the transport of the blanks and the shaping tools.

An exemplary embodiment will be described below with reference to the drawings. In these:

DESCRIPTION OF A PREFERRED EMBODIMENT

Figure 1:
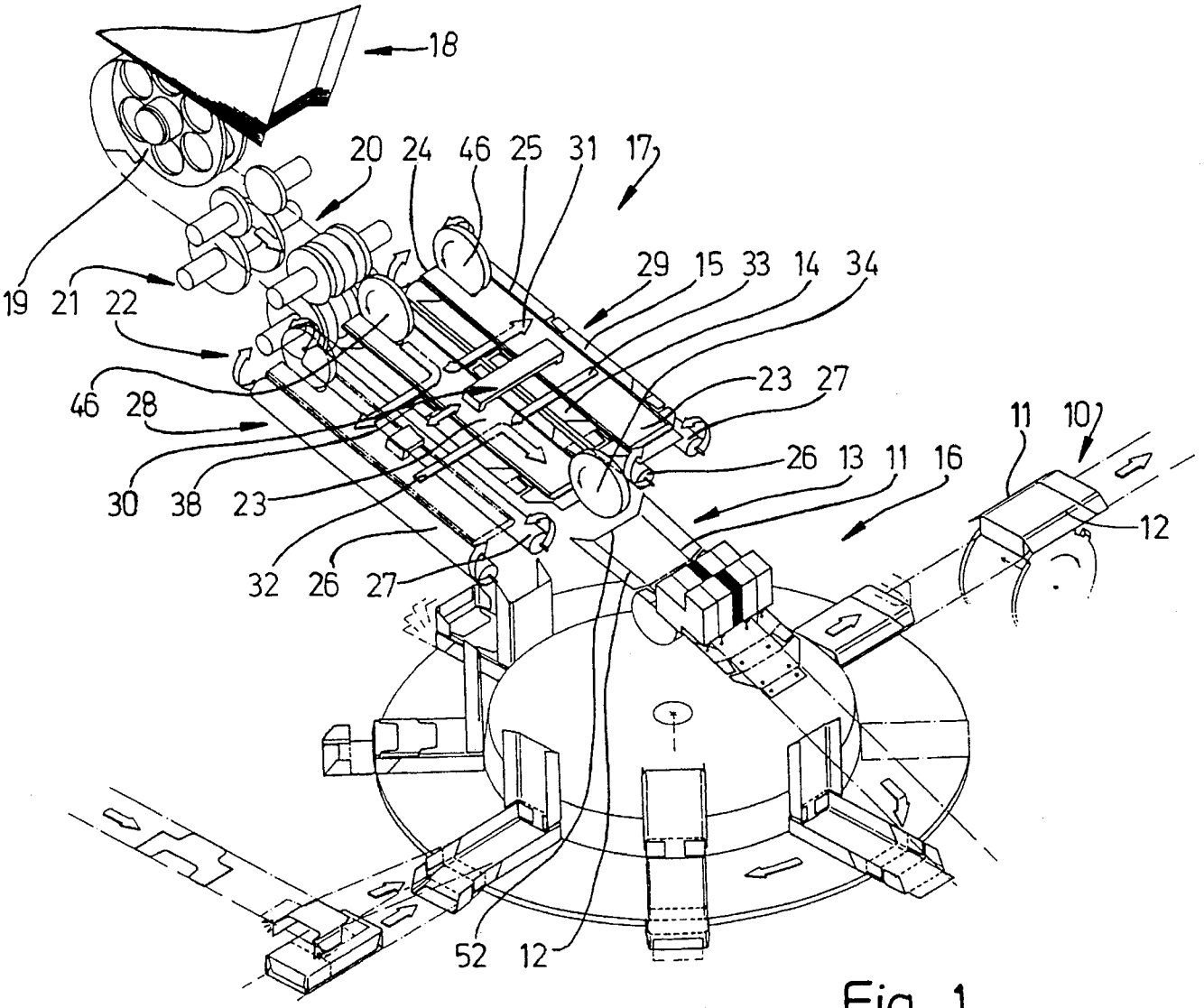
FIG. 1 shows a part of a packaging machine for hinge-lid packs, in a perspective view.
Figure 2:
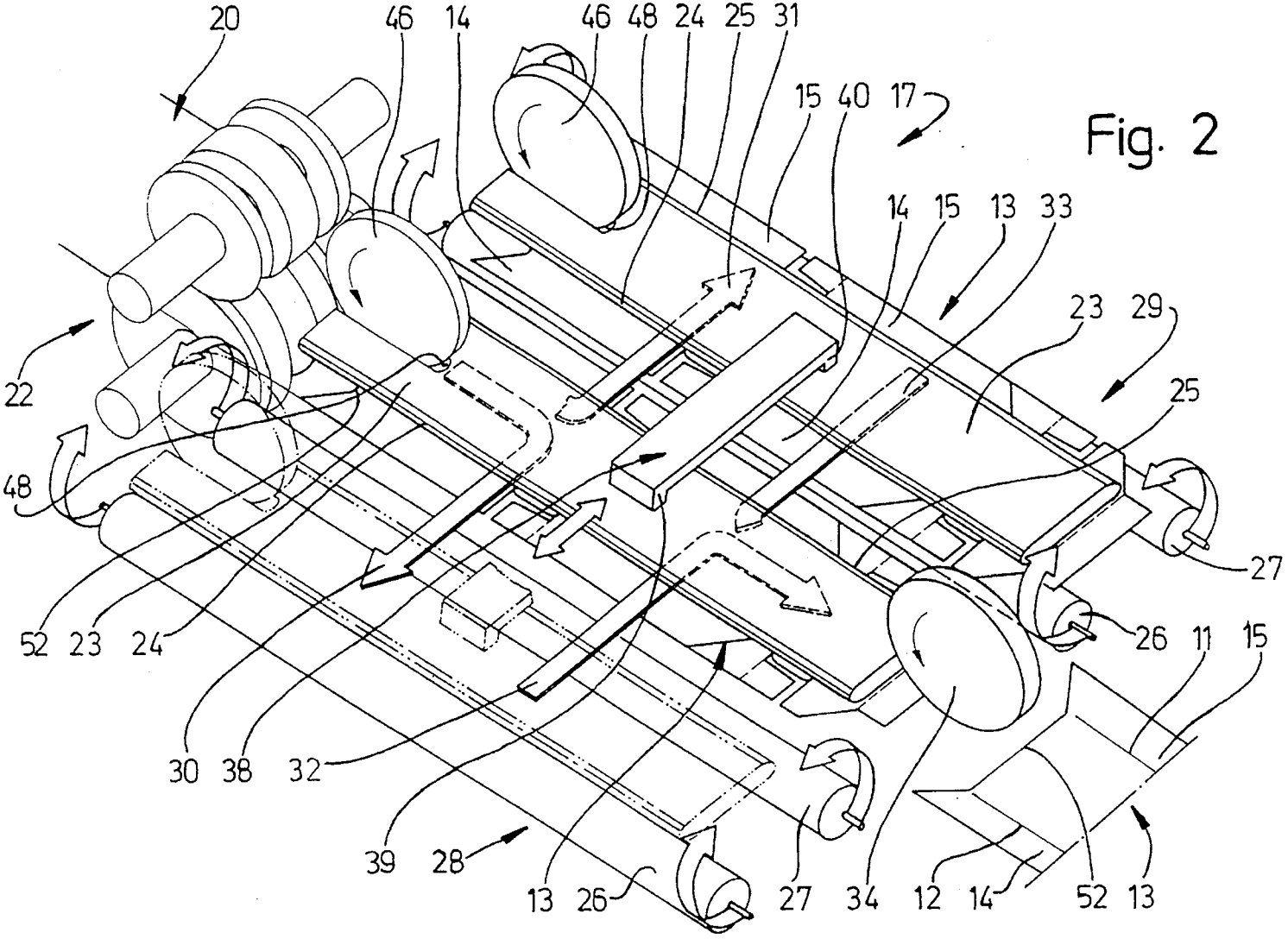
FIG. 2 shows a detail of the representation according to FIG. 1, namely a shaping station, also in a perspective view, on an enlarged scale.

The exemplary embodiment of an apparatus, or a part of a packaging machine, shown in the drawings relates to the production of hinge-lid packs 10 with rounded longitudinal edges 11, 12, according to U.S. Pat. No. 4,753,383. For the production of such a hinge-lid pack 10, a blank 13 is employed which is also shown in U.S. Pat. No. 4,753,383. In order to produce a hinge-lid pack 10 with rounded edges, the blank 13 is pre-shaped in the region of the longitudinal edges 11, 12. Strip-shaped regions of the blank 13 between side tabs 14, 15, on the one hand, and a center portion of the blank, on the other, are shaped into a round shape. The blank 13 prepared in this manner is then fed to an appropriate packaging machine. In the exemplary embodiment of FIG. 1, a folding turret is shown as a part of the packaging machine which may correspond to the folding turret shown in U.S. Pat. No. 4,084,393.

For shaping, or for the preparatory shaping treatment of the blank 13, a shaping station 17 is arranged upstream of the packaging machine, or the folding turret 16. The unfolded blanks 13 are withdrawn from the bottom of a conventional blank magazine 18, in the present case by means of a so-called roll-off device 19. The blanks 13 are then fed to the shaping station 17 along a blank track 20 at predetermined distances in the horizontal direction, or in a slightly sloping (inclined) plane in the conveying direction. For this purpose, transport means, specifically first transport rollers 21 and second transport rollers 22, are arranged in the region of the blank track 20. The conveying rollers facing the shaping station 17 at the same time operate as coding members for the blank 13.

In the region of the shaping station 17, there are located shaping tools which, during a momentary stillstand phase, deform the longitudinal edges 11, 12 of the blank 13, thereby forming curves. These are, on the one hand, a stationary shaping tool, namely a shaping plate 23 with lateral shaping, in the present case semicircular rounded, longitudinal margins 24, 25. The cross-sectional curve of the longitudinal margins 24, 25 corresponds to the curve of the longitudinal edges 11, 12. Two movable shaping tools, specifically elongate shaping rollers 26 and 27, interact with the shaping plate 23. These shaping rollers are disposed stationarily, but movably.

Figures 3, 4:
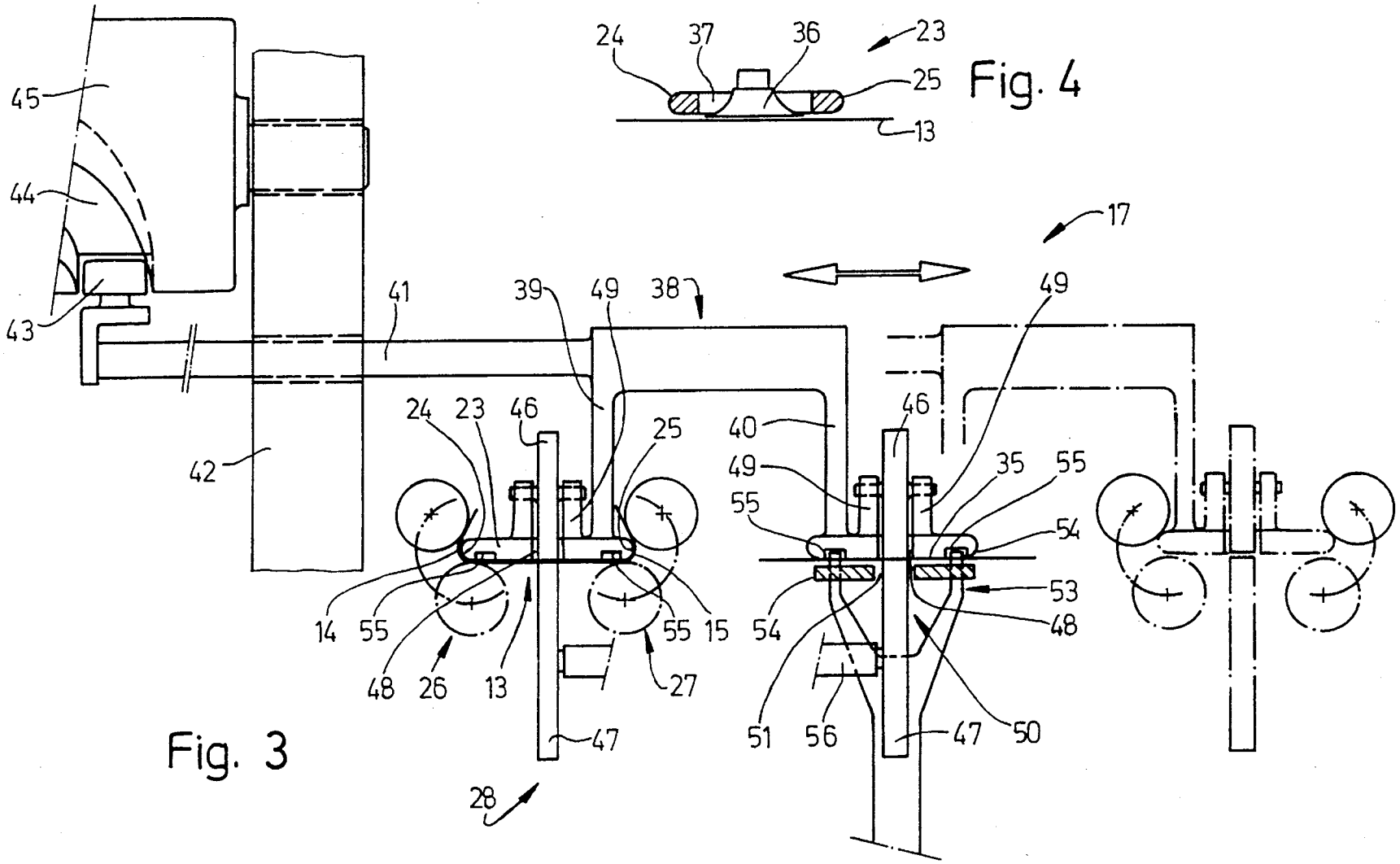
FIG. 3 shows a cross-section through a shaping station according to FIG. 2.
FIG. 4 shows a detail of the shaping station, namely a shaping plate, in cross-section.

The shaping tools described above, namely the shaping plate 23 and two shaping rollers 26, 27, form a shaping device 28, 29. The shaping is carried out inside the shaping device 28, 29 in such a manner that the blank 13 is fixed to the bottom side of the shaping plate 23, thereby adjoining the same. Lateral regions of the blank 13, namely the side tabs 14, 15, project from the shaping plate 23 on both sides. The shaping rollers 26, from a lower starting position below the shaping plate 23 and below the blank 13, are moved around the longitudinal margins 24, 25 of the shaping plate 23, thereby taking along the side tabs 14, 15 and rolling around the shaping plate 23, up to the upper side (FIG. 4). By this rolling movement, the regions of the blank 13 to be rounded are pressed against the longitudinal margins 24, 25 and receive their rounded shape. The shaping rollers 26, 27 then return into their starting position below the shaping plate 23. The pre-shaped blank can now be transported further, namely to the folding turret 16.

The shaping station 17, in the present exemplary embodiment, is equipped with two shaping devices 28, 29, which are both provided with a complete set of shaping tools. The shaping devices 28, 29 are located on both sides of the blank track 20, which thus extends between the shaping devices 28, 29. The supplied blanks 13 are alternately fed to one or the other shaping device 28, 29 by a transverse movement (arrow 30 or 31), deformed, and then moved back into the central position, and thus into the blank track 20, according to arrow 32 or 33. The respective processed blank is then transported away by means of, inter alia, a central transport roller 34.

For the to and fro transverse movement of the blanks 13 in the shown exemplary embodiment, the shaping plates 23 can be moved transversely as a part of each shaping device 28, 29. In a receiving position in the middle of the shaping station 17, and thus in the blank track 20, an unshaped blank 13 is fed to the respective shaping plate 23, specifically in the region of the bottom side of the shaping plate 23. The blank adjoins a stop surface 35 of the shaping plate 23. The shaping plate 23 is provided with holding members on its bottom side for fixing the blank 13. In the present case, the holding members take the form of preferably a plurality, e.g. two suction members 36 which—as FIG. 4 shows as an example—are positioned in a recess 37 of the shaping plate 23. The suction members 36 are effective at the bottom side, namely on the stop surface 35 and are subjected to subatmospheric pressure from above. The shaping plates 23 thus also fulfill the function of a blank holder. The shaping plates 23 are assigned a double-function as shaping tools and as blank holders.

The shaping plate 13, with the blank 13 fixed in such a manner, is moved laterally to the assigned shaping device 28, 29. In this lateral position next to the blank track 20, the shaping is then carried out in the described manner.

The transverse movements of the shaping plates 23 of the shaping devices 28, 29 are adapted to one another. For this purpose, the two shaping plates of the shaping devices 28, 29 are connected to one another. In the present case, a bridge 38 is provided, the upright legs 39, 40 of which are connected to the upper side of the shaping plates 23. The bridge 38 can be moved transversely as a unit. Corresponding movements of the bridge 38 thus cause a simultaneous movement of both shaping plates 23. Thus, one shaping plate is always moved out of the assigned shaping device 28, whereas the other shaping plate is moved into the shaping device 29.

In the present case, the bridge 38 is connected to a connecting rod 41, which is slidably mounted in a supporting wall 42. The free end of the connecting rod is connected with an actuating member, in the present case a tracer roller 43, which runs in a curved groove 44 of a rotatably driven controller member 45. By a rotating movement of the cylindrical controller member 45, the to and fro movements of the connecting rod 41 are generated.

To ensure the accurate guiding and positioning of the blank 13 when transferring it to a shaping plate 23, each shaping plate 23 is assigned upper and lower guide rolls 46, 47. In the present case these are assigned to the shaping plates themselves. The upper guide roll 46, with a lower region, enters into a slot 48 at the end of the shaping plate. Bearing webs 49 on the upper side of the shaping plate 23 bear these guide rolls 46. The lower guide roll 47 is also connected to the shaping plate 23 in a manner not shown in detail. The guide rolls 46, 47 are arranged at a close distance from the transport rollers 22 so that in this region of transfer of the blank 13 to the shaping plate 23 guidance by a plurality of members is ensured.

Below the shaping plate, as a part of the blank track 20, there is located a track plate 50. This track plate 50 is provided with a longitudinal slot 51 at least in a part region. The untreated blank 13, which is fed to the shaping station 17, is first disposed onto the track plate 50. Opposite of the bottom side of the shaping plate 23, namely of the stop surface 35, there is a small distance. By exerting pressure on the suction members 36, the blank is lifted off the track plate 50 and laid against the stop surface 23.

A particularity relates to the discharge of the blanks 13 processed by deforming. On the rearward edge 52 of the respective blank 13, a pushing-off member is effective which pushes the blank 13 on the track plate 50 further (after the blank has been deposited by the shaping plate 23), until it is grasped by the transport roller 34 which interacts with a counter roller which is not shown. The pushing-off member is a push fork 53 which can be moved to and fro. This push fork 53 grasps the rearward edge 52 of the blank with upper ends 44 and transports it in the direction of the blank track 20. The ends 54 thereby enter into the grooves 55 on the bottom sides of the shaping plate 23.

What is claimed is:

1. An apparatus for shaping or pre-shaping blanks (13) for packs with rounded or polygonal longitudinal edges (11, 12), said apparatus having a shaping station (17) in which the blanks (13) are shaped by movable shaping tools in conjunction with shaping plates (23), and then are further transported in a longitudinal direction, wherein the shaping station (17) is provided with at least first and second shaping devices (28, 29) having shaping tools, wherein said apparatus comprises means for successively conveying the blanks into the shaping station (17), and for alternately feeding the blanks to said first and second shaping devices (28, 29);

wherein said first and second shaping devices (28, 29) are arranged next to one another, adjacent to a blank track (20), in a common plane, wherein the blanks (13) are alternately fed to said shaping devices (28, 29) by a transverse movement;

wherein the blanks (13) arriving at the shaping station are fed to a blank holder (23) in a region of the blank track (20), and are laterally moved with the blank holder to the one or the other of said shaping devices (28, 29).

2. The apparatus as claimed in claim 1, wherein each shaping tool comprise a shaping plate (23) which is stationary during the shaping of a blank (13), and which is transversely moved as a blank holder for receiving a blank (13) in the region of the blank track (20), and for the transfer of the blank to one of the shaping devices (28, 29).

3. The apparatus as claimed in claim 2, wherein the blanks (13) are successively fed along the blank track (20) on a bottom side of the shaping plate (23) which is in a blank receiving position, and is fixed by holding members (36) on a lower stop surface (35) of the shaping plate (23).

4. The apparatus as claimed in claim 2, wherein untreated blanks (13) are fed to the shaping plate (23), and are transported and guided by guide rolls (46, 47) which take effect in a front region of the shaping plate (23), wherein the guide rolls (46, 47), which are arranged in a central plane, are connected to the shaping plate (23), and wherein an upper one of said guide rolls (46) protrudes through a slot (48) in the shaping plate (23), so that the guide rolls (46, 47) are effective on a bottom side of the shaping plate (23).

5. The apparatus as claimed in claim 2, wherein, at a small distance from a shaping plate (23) which is in a receiving position, a track plate (50) is arranged as a part of the blank track (20), onto which a supplied respective blank (13) is deposited for being received by the shaping plate (23).

6. An apparatus as claimed in claim 1, wherein the blank holder comprising two shaping plates (23) of the first and second shaping devices (28, 29) is arranged on a common carrier (38), and is jointly and simultaneously moved in the transverse direction such that one of said shaping plates (23) with a blank (13) is always in a receiving position in the region of the blank track, and the other of said shaping plates (23) with a blank (13) is in a region of an assigned one of the shaping devices (28, 29).

7. The apparatus as claimed in claim 1, further comprising a pushing-off member (53) for discharging, along the blank track (20), a blank (13) deposited in a region of the blank track (20) on the track plate (50), after deformation, can be discharged in the direction of the blank track (20) by a pushing-off member, especially by a push fork (53) which is movable to and fro and which takes effect on a rearward edge (52) of the blank (13).

8. The apparatus as claimed in claim 7, wherein said pushing-off member comprises a push-fork (53) which is movable to and fro and which takes effect on a rearward edge (52) of the blank (13).

9. An apparatus for shaping or pre-shaping blanks (13) for packs with rounded or polygonal longitudinal edges (11, 12), said apparatus having a shaping station (17) in which the blanks (13) are shaped by movable shaping tools in conjunction with shaping plates (23), and then are further transported in a longitudinal direction, wherein the shaping station (17) is provided with at least first and second shaping devices (28, 29) having shaping tools, wherein said apparatus comprises means for successively conveying the blanks into the shaping station (17), and for alternately feeding the blanks to said first and second shaping devices (28, 29);

wherein said first and second shaping devices (28, 29) are arranged next to one another, opposite sides of a longitudinal blank track (20), in a common plane, wherein the blanks (13) are alternately fed to said shaping devices (28, 29) by a transverse movement; and wherein said shaping station (17) further comprises means for grasping one of the blanks arriving at the shaping station and for carrying out said transverse movement, relative to the blank track (20), to one or the other of said shaping devices (28, 29).

10. An apparatus for shaping or pre-shaping blanks (13) for packs, comprising:

means for feeding the blanks (13), individually and successively, to a shaping station (17) along a longitudinal blank track (20);

wherein the shaping station (17) comprises two shaping devices (28, 29), one on each side of the blank track (20), for shaping edges of the blanks;

wherein the shaping station (17) comprises first means for grasping one of the blanks (13) in a region of the blank track (20) and for carrying out a lateral movement, transversely relative to the blank track (20), up to a region of one or the other shading device (28, 29); and wherein said first means comprises a first and a second shaping plate (23), means for moving the first shaping plate (23) out of a region of the blank track (20) into a region of one of the shaping devices (28) and back into the region of the blank track (20), and for moving the second shaping plate (23) out of the region of the blank track (20) into a region of the other shaping device (29) and back into the region of the blank track (20).

11. The apparatus as claimed in claim 10, wherein the two shaping plates (23) are arranged on a common carrier (38) and are jointly and simultaneously movable thereby, such that one shaping plate (23) with one of the blanks (13) is always in a receiving position in a region of the blank track, and the other shaping plate (23) with another one of the blanks (13) is in a region of an assigned one of said shaping device (28, 29).

12. The apparatus as claimed in claim 10, wherein the two shaping devices (28, 29) are arranged adjacent to one another in a common, horizontal or slightly sloping plane.

13. The apparatus as claimed in claim 10, wherein the shaping devices (28, 29) are provided with shaping tools interacting with the shaping plates (23) for shaping the blanks (13).

14. The apparatus as claimed in claim 13, wherein the shaping tools are shaping rollers (26, 27), two shaping rollers for each shaping device (28 or 29), which are movable around longitudinal edges (24, 26) of the shaping plates.

15. The apparatus as claimed in claim 10, wherein said first means feeds the blanks (13) successively along the blank track (20) on a bottom side of the shaping plate (23) which is in the receiving position, and wherein said apparatus further comprises holding members (36) for fixing the blanks on a lower stop surface (35) of the shaping plate (23).

16. The apparatus as claimed in claim 10, wherein untreated blanks (13) are fed to the shaping plate (23) and are transported and guided by guide rolls (46, 47) which take effect in a front region of the shaping plate (23), wherein the guide rolls (46, 47) are arranged in a central plane and are connected to a respective shaping plate (23), and wherein an upper one of the guide rolls (46) projects through a slot (48) in the shaping plate (23) so that the guide rolls (46, 47) are effective on the bottom side of the shaping plate (23).

17. The apparatus as claimed in claim 10, wherein, at a small distance from a shaping plate (23) which is in a blank-receiving position, there is provided, as a part of the blank track (20), a stationary track plate (50) onto which a supplied respective blank (13) is deposited for being received by the shaping plate (23).

18. The apparatus as claimed in claim 10, further comprising a pushing-off member for discharging, along the blank track (20), a blank (13) deposited in a region of the blank track (13), after deformation, said pushing-off member comprising a push fork (53) which is movable to and fro and which takes effect on a rearward edge (52) of the blank.

19. The apparatus as claimed in claim 10, wherein the edges are rounded or polygonal longitudinal edges (11, 12) of a hinge-lid pack, and wherein said shaping devices (28, 29) form the longitudinal edges by deforming corresponding edges of each blank.

* * * * *